US006582093B1

(12) United States Patent
Branaugh et al.

(10) Patent No.: US 6,582,093 B1
(45) Date of Patent: Jun. 24, 2003

(54) ILLUMINATING DEVICE FOR A PURSE

(76) Inventors: Mary A. Branaugh, 1223 Silver Knoll, Las Vegas, NV (US) 89121; Haunani Lytle, 2134 Lipari Ct., Las Vegas, NV (US) 89123

( * ) Notice: Subject to any disclaimer, the term of this patent is extended or adjusted under 35 U.S.C. 154(b) by 0 days.

(21) Appl. No.: 09/655,049

(22) Filed: Sep. 5, 2000

(51) Int. Cl.[7] ..... A45C 15/06
(52) U.S. Cl. ..... 362/156; 362/155
(58) Field of Search ..... 362/154, 155, 362/156, 190, 191, 276, 802, 253

(56) References Cited

U.S. PATENT DOCUMENTS 1,739,316 A * 12/1929 Koban et al. ..... 362/155
2,179,214 A * 11/1939 Hallbauer ..... 362/156
2,218,396 A * 10/1940 Hallbauer ..... 362/156
4,084,085 A * 4/1978 Kim ..... 362/156
4,912,611 A * 3/1990 Lyle ..... 362/156
5,424,926 A * 6/1995 Myers ..... 362/155
5,908,232 A * 6/1999 Burns et al. ..... 362/191

FOREIGN PATENT DOCUMENTS

FR 002570165 A1 * 3/1986
WO 00/30492 * 6/2000

* cited by examiner

*Primary Examiner*—Y. My Quach-Lee
(74) *Attorney, Agent, or Firm*—Jeffrey D. Moy; Harry M. Weiss; Weiss & Moy, P.C.

(57) ABSTRACT

A purse has an illuminating device. The purse has a main storage area. A flap member is provided and has a first end permanently coupled to the main storage area and a second end removably coupled to the main storage area. A lighting device is coupled to the purse. The lighting device has a power supply and a light element coupled to the power supply. A housing unit is coupled to the flap member of the purse and holds the power supply and light element. A spring loaded switch is coupled to the flap member and automatically causes the lighting device to activate when the flap member is lifted.

10 Claims, 1 Drawing Sheet

ILLUMINATING DEVICE FOR A PURSE

BACKGROUND OF THE INVENTION

1. Field of the Invention

This invention relates to lights and, more specifically, to a light for a purse which automatically illuminates when the purse is opened.

2. Description of the Prior Art

When opening up a purse or backpack, it is difficult to see the contents inside. For this reason, lighting devices have been designed to illuminate the inside of the purse or backpack. In general, most purse/backpack lights (hereinafter purse lights) are mounted to an inside compartment of the purse. The lights have a manual switch which must be moved by the user in order to activate the purse light.

There are several problems with these types of purse lights. First, as stated above, these types of lights require the user to activate the light. In dark rooms or areas, it is often difficult to locate the light switch. Thus, one will have to feel around in the purse to locate the light switch. This is both time consuming and bothersome to the user.

Another problem is that most purse lights are stationary. The purse light is often sewn into a section of the purse. Thus, only the area around the purse light is illuminated. For someone with a rather large purse, the majority of the interior section would not be illuminated when the purse light is activated.

Therefore, a need existed to provide an improved lighting device for a purse. The improved lighting device for the purse must be able to automatically activate once the purse has been opened. The improved lighting device for the purse must further be able to light all areas of the purse.

SUMMARY OF THE INVENTION

In accordance with one embodiment of the present invention, it is an object of the present invention to provide an improved lighting device for a purse.

It is another object of the present invention to provide an improved lighting device for a purse that will automatically activate once the purse has been opened.

It is still another object of the present invention to provide an improved lighting device for a purse that is able to light all areas of the purse.

BRIEF DESCRIPTION OF THE PREFERRED EMBODIMENTS

In accordance with one embodiment of the present invention a purse with an illuminating device is disclosed. The purse has a main storage area. A flap member is provided and has a first end permanently coupled to the main storage area and a second end removably coupled to the main storage area. A lighting device is coupled to the purse. The lighting device has a power supply and a light element coupled to the power supply. A housing unit is coupled to the flap member of the purse and holds the power supply and light element. A spring loaded switch is coupled to the flap member and automatically causes the lighting device to activate when the flap member is lifted.

In accordance with another embodiment of the present invention a purse with an illuminating device is disclosed. The purse has a main storage area. A flap member is provided and has a first end permanently coupled to the main storage area and a second end removably coupled to the main storage area. A lighting device is coupled to the purse. The lighting device has a power supply and a light element coupled to the power supply. A housing unit is coupled to an interior section of the main storage area of the purse and holds the power supply and light element. The housing may be permanently coupled to the interior section of the main storage area or the housing may be removably coupled to the interior section of the main storage area. A spring loaded switch is coupled to the flap member and automatically causes the lighting device to activate when the flap member is lifted.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENT

Figure 1:
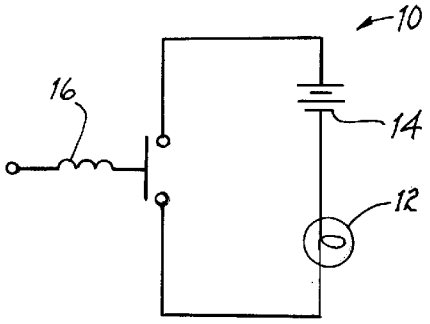
FIG. 1 is a simplified electrical schematic of the illuminating device for a purse.

Referring to FIG. 1, a simplified electrical schematic of the purse light 10 of the present invention is shown. The purse light 10 has a light source 12. The light source 12 is coupled to a power supply 14. The power supply 14 is generally a battery. However, other small power supply devices 14 could be used. The power supply 14 and light source 12 are both coupled to a switch 16. The switch 16 is used to activate and deactivate the purse light.

In one embodiment of the present invention, the switch 16 is a spring loaded switch 16. The spring loaded switch 16 will allow for automatic activation of the purse light 10 when the purse is opened. The spring loaded switch 16 functions as follows. When the spring loaded switch 16 is allowed to extend, the spring loaded switch 16 will close the light circuit allowing the light source 12 to illuminate. When the purse is closed, the spring loaded switch 16 contracts thereby opening the light circuit. With the light circuit open, no current is allowed to flow to the light source 12. Thus, the light source 12 will not be illuminated.

Figure 2:
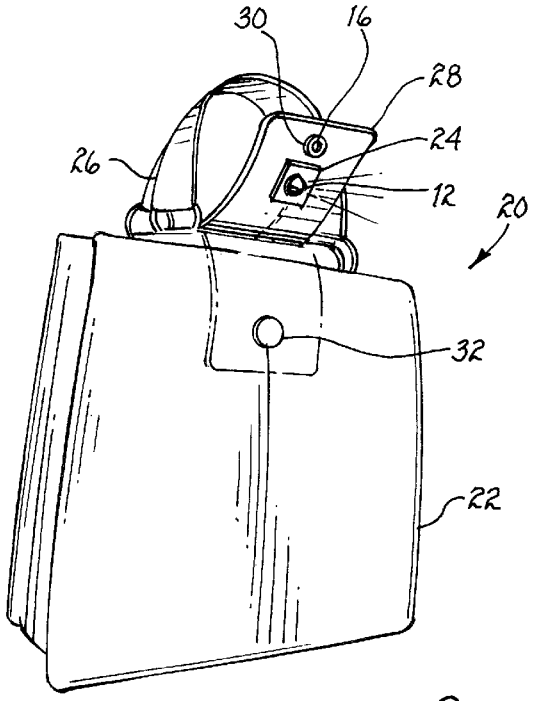
FIG. 2 is an elevated perspective view of one embodiment of the illuminating device for a purse.

Referring now to FIGS. 1 and 2 wherein like numerals and symbols represent like elements, one embodiment of the present invention is shown. In this embodiment, the purse light 10 has a housing 24. The housing 24 is used to store and support the power source 14 and the light source 12. In order to activate the purse light 10, the spring loaded switch 16 is coupled to the housing 24.

The purse light 10 is used with a purse 20. The purse 20 has a main storage compartment 22. A plurality of smaller storage compartments may be located in an interior section of the main storage compartment 22 or on the exterior section of the main storage compartment 22. A carrying handle 26 is coupled to the main storage compartment 22. The carrying handle 26 is used to carry the purse 20. It should be noted that the carrying handle 26 can be of various lengths and widths. The carrying handle 26 may even be fairly long so as to allow the user to place the carrying handle 26 over the shoulder of the user.

The purse 20 also has a flap member 28. The flap member 28 is used to open and close the main storage compartment 22. The flap member 28 is coupled to the main storage compartment 22. One end of the flap member 28 is permanently coupled to the main storage compartment 22. The second end of the flap member 28 is removably coupled to the main storage compartment 22. In order to removably couple the second end of the flap member 28 to the main storage compartment 22, a fastener mechanism is used. In the embodiment depicted in FIG. 2, the fastener mechanism has two components. The first connector 30 is coupled to the flap member 28. A second connector 32 is coupled to the main storage compartment 22. The first and second connectors 30 and 32 may be any type of connectors that allows the flap member 28 to be removably coupled to the main storage compartment. For example, the first and second connectors 30 and 32 may be male/female connectors, hook and loop connectors, magnetic connectors or the like.

Located on the flap member 28 is the purse light 10. The housing 24 which is used to store and support the power source 14 and the light source 12 is coupled to the flap member 28. The housing 24 is coupled to the flap member 28 so that the light source 12 is exposed on the underside of the flap member 28. By having the light source 12 coupled to the flap member 28, one can move the flap member 28, and thus the light source 12 around the interior section of the main storage compartment 22. This allows the user to provide a source of light to the majority of areas within the main storage compartment 22.

The spring loaded switch 16 is coupled to the flap member 28 and to the housing 24. In the embodiment depicted in FIG. 2, the spring loaded switch 16 is coupled to the first connector 30 of the fastener mechanism. When the user uncouples the first connector 30 from the second connector 32, the spring loaded switch 16 will extend thereby closing the path on the light circuit. Current will then flow in the light circuit thereby illuminating the light source 12. When the flap member 28 is closed so that the first connector 30 and second connector 32 are coupled together, the spring loaded switch 16 contracts thereby opening the light circuit. With the light circuit open, no current is allowed to flow to the light source 12. Thus, the light source 12 will be turned off.

Figure 3:
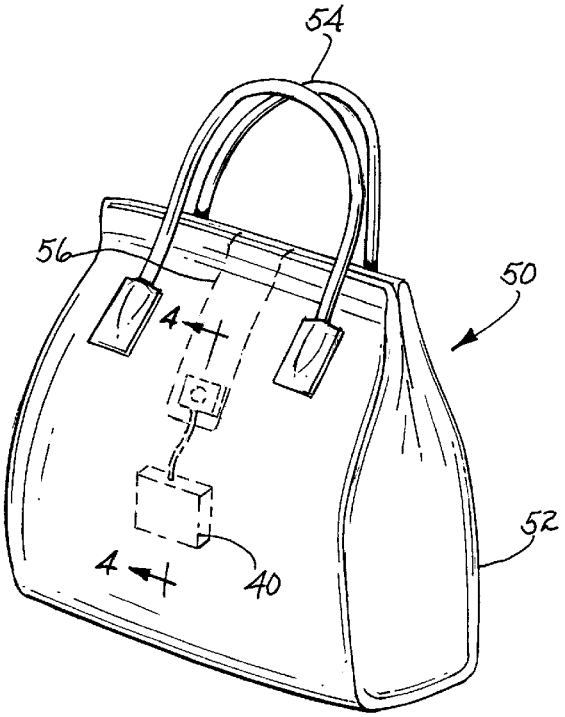
FIG. 3 is an elevated perspective view of another embodiment of the illuminating device for a purse.
Figure 4:
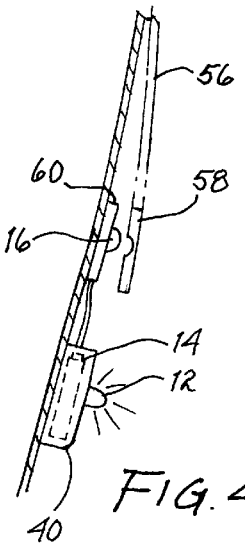
FIG. 4 is a cross-sectional view of the illuminating device for a purse depicted in FIG. 3 taken along line 4—4.

Referring now to FIGS. 3–4 wherein like numerals and symbols represent like element, another embodiment of the present invention is shown. This embodiment is similar to the embodiment shown in FIG. 2. The main difference is the type of purse which is using the purse light 10 (FIG. 1) and the location of the purse light 10. In this embodiment, the purse light 10 has a housing 40. The housing 40 is used to store and support the power source 14 and the light source 12. In order to activate the purse light 10, the spring loaded switch 16 is coupled to the housing 40.

The purse light 10 is used with a purse 50. The purse 50 has a main storage compartment 52. A plurality of smaller storage compartments may be located in an interior section of the main storage compartment 52 or on an exterior section of the main storage compartment 52. A carrying handle 54 is coupled to the main storage compartment 52. The carrying handle 54 is used to carry the purse 50. It should be noted that the carrying handle 54 can be of various lengths and widths. The carrying handle 54 may even be fairly long so as to allow the user to place the carrying handle 54 over the shoulder of the user.

The purse 50 also has a flap member 56. The flap member 56 is used to open and close the main storage compartment 52. The flap member 56 is coupled to the main storage compartment 52. One end of the flap member 56 is permanently coupled to the main storage compartment 52. The second end of the flap member 56 is removably coupled to the main storage compartment 52. In order to removably couple the second end of the flap member 56 to the main storage compartment 52, a fastener mechanism is used. In the embodiment depicted in FIGS. 3–4, the fastener mechanism has two components. The first connector 58 is coupled to the flap member 56. A second connector 60 is coupled to the main storage compartment 52. The first and second connectors 58 and 60 may be any type of connectors that allows the flap member 56 to be removably coupled to the main storage compartment 52. For example, the first and second connectors 58 and 60 may be male/female connectors, hook and loop connectors, magnetic connectors or the like.

Located in the interior section of the main storage compartment 52 is the purse light 10. The housing 40 which is used to store and support the power source 14 and the light source 12 is coupled to the interior section. The housing 40 may be permanently or removably coupled to the interior of the main storage compartment 52. If the housing 40 is removably coupled to the interior section, this would allow the user of the purse 50 to detach the housing when the light is illuminated to look within the interior section of the main storage compartment 52.

The spring loaded switch 16 is coupled to the flap member 56 and to the housing 40. In the embodiment depicted in FIG. 2, the spring loaded switch 16 is coupled to the first connector 58 of the fastener mechanism. When the user uncouples the first connector 58 from the second connector 60, the spring loaded switch 16 will extend thereby closing the path on the light circuit. Current will then flow in the light circuit thereby illuminating the light source 12. When the flap member 56 is closed so that the first connector 58 and second connector 60 are coupled together, the spring loaded switch 16 contracts thereby opening the light circuit. With the light circuit open, no current is allowed to flow to the light source 13. Thus, the light source 12 will be turned off.

It should be noted that other mechanism could also be used in conjunction with the flap to open and close the main compartment in both embodiments. For example, the main compartment could be closed by a zipper, a latch, a knob closure, or similar mechanisms. The flap would then be used in conjunction with the other closing mechanisms in a manner as shown in the embodiments depicted in the Figures.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A purse with an illuminating device comprising, in combination:

a purse comprising:

a main storage area; and a flap member having a first end permanently coupled to the main storage area and a second end removably coupled to the main storage area; and a lighting device coupled to the flap member of the purse so the lighting device may be moved within the main storage area of the purse, wherein the lighting device comprises:

a power supply;

a light element coupled to the power supply;

a housing coupled to the flap member which holds the power supply and light element; and a spring loaded switch coupled to the flap member and which automatically causes the light element to activate when the flap member is lifted.

2. A purse with an illuminating device in accordance with claim 1 wherein the purse further comprises a fastening mechanism for removably coupling the second end of the flap member to the main storage area.

3. A purse with an illuminating device in accordance with claim 2 wherein the fastening mechanism comprises:

a first connector coupled to the main storage area; and a second connector coupled to the flap member.

4. A purse with an illuminating device in accordance with claim 1 wherein the purse further comprises carrying steps coupled to the main storage area for allowing the user to carry the purse.

5. A purse with an illuminating device in accordance with claim 1 wherein the purse further comprises a plurality of compartment areas coupled to the main storage area.

6. A purse with an illuminating device in accordance with claim 1 wherein the purse further comprises a closing device coupled to the main storage area for opening and closing the main storage area.

7. A purse with an illuminating device comprising, in combination:

a purse comprising:

a main storage area; and a flap member having a first end permanently coupled to the main storage area and a second end removably coupled to the main storage area;

a fastening mechanism for removably coupling the second end of the flap member to the main storage area;

carrying straps coupled to the main storage area for allowing the user to carry the purse; and a lighting device coupled to the flap member of the purse so the lighting device may be moved within the main storage area of the purse, wherein the lighting device comprises:

a power supply;

a light element coupled to the power supply;

a housing coupled to the flap member which holds the power supply and light element; and a spring loaded switch coupled to the flap member and which automatically causes the light element to activate when the flap member is lifted.

8. A purse with an illuminating device in accordance with claim 7 wherein the fastening mechanism comprises:

a first connector coupled to the main storage area; and a second connector coupled to the flap member.

9. A purse with an illuminating device in accordance with claim 7 wherein the purse further comprises a plurality of compartment areas coupled to the main storage area.

10. A purse with an illuminating device in accordance with claim 7 wherein the purse further comprises a closing device coupled to the main storage area for opening and closing the main storage area.

* * * * *